US006878678B2

(12) United States Patent
Saputra et al.

(10) Patent No.: US 6,878,678 B2
(45) Date of Patent: Apr. 12, 2005

(54) OIL COMPOSITION FOR AUTOMATIC TRANSMISSION

(75) Inventors: Asep Handaya Saputra, Depok (ID); Tomohiro Kato, Saitama-ken (JP); Narihiko Yoshimura, Saitama-ken (JP)

(73) Assignee: Tonen General Sekiyu K.K., Saitama (JP)

( * ) Notice: Subject to any disclaimer, the term of this patent is extended or adjusted under 35 U.S.C. 154(b) by 0 days.

(21) Appl. No.: 10/112,113

(22) Filed: Mar. 29, 2002

(65) Prior Publication Data

US 2004/0014619 A1 Jan. 22, 2004

(30) Foreign Application Priority Data

Sep. 13, 2001 (JP) ..... 2001-277844

(51) Int. Cl.[7] ..... C10M 129/74
(52) U.S. Cl. ..... 508/486; 508/491
(58) Field of Search ..... 508/486, 491

(56) References Cited

U.S. PATENT DOCUMENTS 2,119,718 A * 6/1938 Pevere
4,683,069 A 7/1987 Brewster et al. ..... 252/32.7 E
5,064,546 A 11/1991 Dasai ..... 252/32.5
5,282,989 A 2/1994 Erickson et al. ..... 252/48.2
5,338,471 A 8/1994 Lal ..... 252/56 S
5,399,275 A 3/1995 Lange et al. ..... 252/49.008
5,413,725 A 5/1995 Lal et al. ..... 252/18
5,641,740 A * 6/1997 Debska-Chwaja
5,750,476 A 5/1998 Nibert et al. ..... 508/291
5,851,962 A * 12/1998 Kaga
5,891,786 A 4/1999 Srinivasan et al. ..... 508/188
6,074,995 A 6/2000 Dohner ..... 508/460
6,255,262 B1 * 7/2001 Keenan et al.

FOREIGN PATENT DOCUMENTS

EP 0554421 11/1993 ..... C10M/169/04

OTHER PUBLICATIONS

Japanese Automobile Standard, "Friction characteristics test method for automatic transmission fluids", JASO M348: 2002, The Society of Automotive Engineers of Japan, Inc., Tokyo, Japan, pp. 1–18.

Japanese Automobile Standard, "Test method for friction property of automatic transmission fluids", JASO M 348–95, The Society of Automotive Engineers of Japan, Inc., Tokyo, Japan, pp. 1–10.

Japanese Automobile Standard, "Automatic transmission fluids—Anti–shudder performance test", JASO M349:1998, The Society of Automotive Engineers of Japan, Inc., Tokyo, Japan, pp. 1–9.

1995 SAE Handbook, "On–Highway Vehicles and Off–Highway Machinery", vol. 3, Society of Automotive Engineers, Inc., Warrendale, PA, pp. 29.101–29.105.

* cited by examiner

*Primary Examiner*—Jerry D. Johnson
(74) *Attorney, Agent, or Firm*—Linda M. Scuorzo; Joseph J. Allocca

(57) ABSTRACT

To provide an oil composition for automatic transmission having high wet friction torque capacity and shudder preventing performance, and excellent also in durability of shudder preventing performance as an automatic transmission oil for lock-up clutch and slip control.

10 Claims, 1 Drawing Sheet

OIL COMPOSITION FOR AUTOMATIC TRANSMISSION

FIELD OF THE INVENTION

This invention relates to an oil composition for automatic transmission, more specifically an oil composition for automatic transmission used for automatic transmissions equipped with a lock-up clutch and slip control mechanism.

BACKGROUND OF THE INVENTION

An automatic transmission for an automobile comprises a torque converter, a wet clutch, a gearbox, and a hydraulic control mechanism for controlling them. In such an automatic transmission where the power from an engine is transmitted through the torque converter as a fluid joint, the transmission loss caused by the difference between the input and output rotations of the torque converter is regarded as the greatest cause of decrease in fuel consumption rate. Accordingly, as a means of improving fuel consumption rate a torque converter with built-in lock-up clutch having a high transmission efficiency has been adapted to reduce the transmission loss, and a slip control system has been introduced to extend its operating area. Since the slip control adapts a system of sliding the lock-up clutch while monitoring the engine rotating speed and the torque converter output rotating speed and controlling its relative slip velocity by the hydraulic mechanism, the lock-up clutch can be operated even in a low velocity area where the direct connection was difficult in the past.

However, it has been recognized that an automatic transmission oil having a performance qualitatively different from the automatic transmission oil used for automatic transmissions equipped with no slip control mechanism is required to make the above automatic transmission smoothly function. Namely, although to increase the torque capacity was the important subject in the past, it is indispensable for the slip control system to be provided with shudder preventing performance, and the transmission torque capacity to wet friction material necessary for reduction in size and weight is also required.

Accordingly, various friction modifiers, for example, phosphate, fatty acid amide and the like have been proposed therefor. However, the transmission torque capacity and the shudder preventing performance are in a trade-off relationship, and in the incorporation with such a fiction modifier, a weak point has been pointed out that the friction coefficient in low slip velocity area of the lock-up clutch part of the automatic transmission is reduced, so that a sufficient transmission torque capacity cannot be provided in the engagement of the lock-up clutch, even if the shudder preventing performance can be improved. Therefore, an automatic transmission oil having an organic acid metal salt such as sulfonate or fenate of calcium or the like mixed therein for the purpose of improving the transmission torque capacity has been proposed.

However, an automatic transmission oil related to the above proposal had a problem that the $\mu$(coefficient of friction)-V(slip velocity) characteristic is deteriorated when used for a long time to shorten the durable life of shudder (stick slip) preventing performance. Namely, although an increase in mixing quantity of the friction modifier is effective in for improvement in $\mu$-V characteristic, a problem has been pointed out that the increase in quantity reduces the friction coefficient in low velocity slip range, so that a sufficient transmission torque capacity cannot be provided in the engagement of the lock-up clutch to cause a loss of power transmission energy.

SUMMARY OF THE INVENTION

Figure 1:
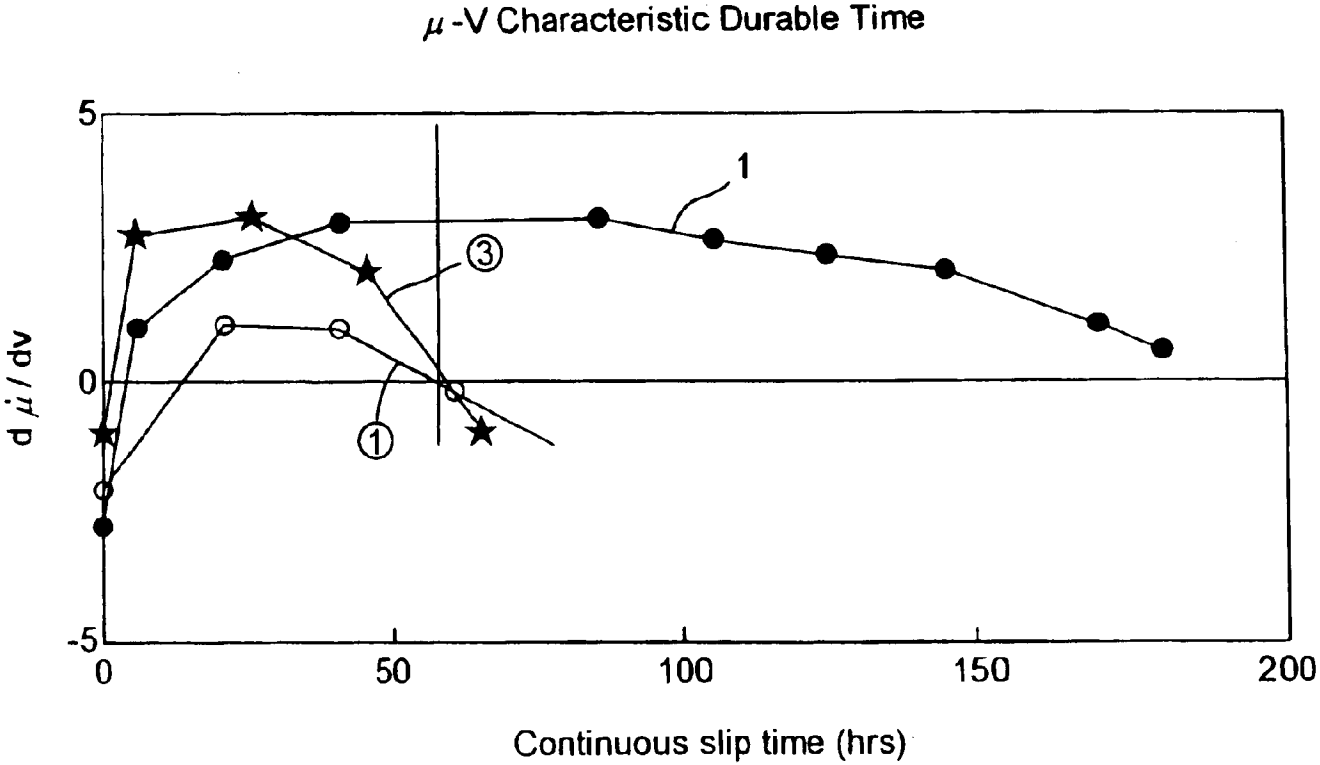
FIG. 1 is a graph showing the evaluation result of $\mu$-V characteristic durability for examples of oil compositions for automatic transmissions. Therein reference marks for the curves are as follows: 1: Durability evaluation curve of $\mu$-V characteristic of the oil composition for automatic transmission of Example 1; 2: Durability evaluation curve of $\mu$-V characteristic of the oil composition for automatic transmission of Comparative Example 1; 3: Durability evaluation curve of $\mu$-V characteristic of the oil composition for automatic transmission of Comparative Example 3.

In view of the problems encountered in the course of development of the conventional automatic transmission oils, the subject of this invention is to provide an oil composition for automatic transmission having a high wet friction material torque capacity and a shudder preventing performance with $\mu$-V characteristic of positive gradient, and enhanced also in durable life of shudder preventing performance.

The present inventors have found that a specified carboxylate-based compound of polyhydric alcohol can keep, as the friction modifier, all performances of transmission torque capacity, $\mu$-V characteristic, and durability of $\mu$-V characteristic at a high level and contribute to the smooth use in a torque converter automatic transmission with slip control mechanism.

Namely, this invention relates to an oil composition for automatic transmission comprising a carboxylic glyceride mixed in a base oil, the carboxylic glyceride consisting of a carboxylic triglyceride and/or a carboxylic diglyceride, each carboxylic residue thereof having a carbon number of 7 to less than 17, and the mixing amount thereof being 0.01 wt % or more, based on the whole composition.

The oil composition for automatic composition containing the base oil and the glyceride mixed to the base oil, which is provided in this invention as described above, further includes those described in the following (1)–(7) as preferred embodiments.

1. An oil composition for automatic transmission comprising a fatty acid triglyceride mixed to a base oil, the fatty acid triglyceride having a fatty acid residue having a carbon number of 10–14, and the mixing amount thereof being 0.01 wt % or more.
2. An oil composition for automatic transmission comprising a fatty acid triglyceride mixed to a base oil, the fatty acid triglyceride having a fatty acid residue having a carbon number of 7 to less than 17, and the mixing amount thereof being 0.01–5 wt %.
3. An oil composition for automatic transmission comprising a fatty acid triglyceride mixed to a base oil, the fatty acid triglyceride having a fatty acid residue having a carbon number of 10–14, and the mixing amount thereof being 0.01–5 wt %.
4. An oil composition for automatic transmission comprising a fatty acid diglyceride mixed to a base oil, the fatty acid diglyceride having a fatty acid residue having a carbon number of 7 to less than 17, and the mixing amount being 2 wt % or less.
5. An oil composition for automatic transmission comprising a fatty acid triglyceride, a fatty acid diglyceride, and a fatty acid monoglyceride mixed to a base oil, the fatty acid triglyceride being 20 wt % or more, based on the total amount of the fatty acid glycerides, and the mixing amount being 0.01 wt % or more.

6. An oil composition for automatic transmission comprising a fatty acid glyceride mixed to a base oil, which further contains at least one additive component selected from the group consisting of viscosity index improver, metallic detergent, ashless dispersant, antioxidant, antiwear agent, metal deactivator, pour point depressant, antifoaming agent, and corrosion inhibitor.
7. An automatic transmission oil composition for slip control consisting of the automatic transmission oil composition according to the above (1)–(6) used for an automatic transmission loaded with a torque converter with slip control mechanism.

DETAILED DESCRIPTION OF THE PREFERRED EMBODIMENTS

This invention is further described in detail below.

Base Oil

As the base oil used as the component of the oil composition for automatic transmission of this invention, any one which is normally used as a lubricant base oil, including a mineral oil, a synthetic oil and a mixture thereof, can be used without limitation. A vegetable oil may be also used.

The mineral base oils to be used include a mineral oil such as solvent-refined raffinate or hydrogen-treated oil obtained by treating a lubricant fraction obtained as the vacuum distillate of the atmospheric distillation residual oil of a paraffin, intermediate or naphthene-based crude oil by use of a process optionally selected from various purification processes, e.g., solvent refining, hydrocracking, hydrogen treating, hydrogenation extraction, catalytic dewaxing, clay treatment and the like; a mineral oil obtained by subjecting the vacuum distillation residual oil to solvent deasphalting, and treating the resulting deasphalted oil by the above purification process; a mineral oil obtained by isomerizing a wax content; and a mixture thereof can be used. An aromatic extractant such as phenol, furfural, N-methyl-2-pyrolidone or the like is used in the above solvent refining, while liquefied propane, MEK/toluene or the like is used as the solvent for solvent dewaxing. In the catalytic deasphalting, for example, shape selective zeolite or the like is used as the deasphalting catalyst.

Examples of the thus-obtained refined mineral oils include light-gravity neutral oil, medium-gravity oil, heavy-gravity neutral oil, bright stock and the like. These base materials are properly compounded so as to satisfy required properties, whereby the mineral base oil can be produced.

Examples of the synthetic base oil include poly α-olefin oligomer [e.g., poly(1-hexene), poly(1-octene), poly(1-decene) etc., and a mixture thereof], polybutene, alkylbenzene (e.g., dodecylbenzene, tetradecylbenzene, di(2-ethylhexyl)benzene, dinonylbenzene, etc.), polyphenyl (e.g., biphenyl, alkylated polyphenyl, etc.), alkylated diphenylether and alkylated diphenylsulfide, and derivatives thereof; esters of dibasic acid (e.g., phthalic acid, succinic acid, alkylsuccinic acid, alkenylsuccinic acid, maleic acid, azelaic acid, suberic acid, sebacic acid, fumaric acid, adipic acid, dimmer linoleate, etc.) with various alcohols (e.g., butylalcohol, hexylalcohol, 2-ethylhexylalcohol, dodecylalcohol, ethyleneglycol, diethyleneglycol, diethyleneglycol monoether, propyleneglycol, etc.); esters of monocarboxylic acid having 5–12 carbon atoms with polyols (e.g., neopentyl glycol, trimethylol propane, pentaerythritol, dipentaerythritol, tripenthaerythritol, etc.); and polyoxyalkylene glycol, polyoxyalkylene glycol ester, polyoxyalkylene glycol ether, phosphate, silicone oil and the like.

Examples of the vegetable base oil include castor oil, coconut oil and the like.

The base oil can be produced by compounding the above base materials independently or in combination of at least two thereof so as to have a desired viscosity and other properties. As the base oil for the oil composition for automatic transmission of this invention, for example, the kinematic viscosity at 100° C. is adjusted in a range of 2–20 $mm^2/s$, preferably 3–15 $mm^2/s$ by compounding various base materials. When the kinematic viscosity of the base oil is too high, the low-temperature viscosity property is deteriorated, and an excessively low viscosity causes a problem of increased wear in a sliding part such as the gear bearing, clutch or the like of the automatic transmission.

Carboxylic Glyceride

The carboxylic glyceride used as the essential component of the oil composition for automatic transmission of this invention is an ester of glycerin with carboxylic aid, which may be based on either vegetable or synthesis. Examples of the carboxylic residue RCO— of the carboxylic glyceride include those derived from fatty acid, aromatic acid, alicyclic acid and the like. The fatty acid residue suitably has a straight chain or branched chain, and it may have the structure of either a saturated fatty acid or an unsaturated fatty acid. Preferably, a fatty acid residue in which the carbon number of R is 7 to less than 17, particularly, 10–14 is suitable. An oil composition for automatic transmission simultaneously satisfying both the transmission torque capacity an the shudder preventing performance with $\mu$-V characteristic of positive gradient and also excellent in $\mu$-V characteristic durability can be provided by using the use of the fatty acid glyceride having the fatty acid residue having a carbon number of 7 to less than 17. When the carbon number is less than 7 and 17 or more, the problem of reduction in torque capacity $\mu_\tau$ is caused.

Examples of the fatty acid glycerides given as the component of the automatic transmission oil of this invention include at least one of fatty acid triglycerides, at least one of fatty acid diglycerides, a mixture thereof, a mixture of this mixture with at least one of fatty acid monoglycerides, more specifically, a mixture of fatty acid triglyceride, fatty acid diglyceride and fatty acid monoglyceride containing 20 wt % or more, to the total amount of all the fatty acid glycerides, preferably, 40 wt % or more of the fatty acid triglycerides. The fatty acid triglyceride, fatty acid diglyceride, or a mixture thereof is particularly preferred. Among them, the fatty acid triglyceride is suitable because it can easily satisfy both performances of the transmission torque capacity and the shudder preventability with $\mu$-V characteristic of positive gradient.

Particularly preferred examples of the fatty acid glycerides include compounds represented by the following general formulae (I)—(III) such as triglyceride, 1,2-diglyceride, 1,3-diglyceride and the like.

Formula 1

(I)

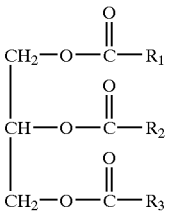

-continued

Formula 2

(II)

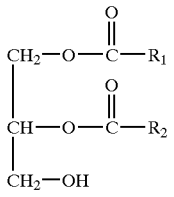

Formula 3

(III)

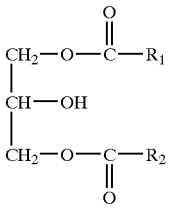

Compounds represented by the following general formulae (IV) and (V) such as 1-monoglyceride, 2-monoglyceride and the like can be also used as a mixture with at least one of the compounds represented by the general formulae (I)–(III).

Formula 4

(IV)

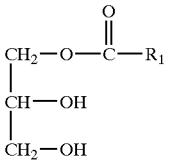

Formula 5

(V)

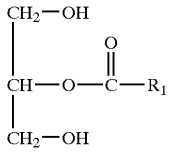

In the above general formulae (I)–(V), $R_1$, $R_2$ and $R_3$, which may be the same or different, each represents a straight or branched alkyl group or alkenyl group, which has a carbon umber of 7 to less than 17. A so-called single glyceride in which $R_1$, $R_2$ and $R_3$ have the same carbon number and a composite glyceride in which they have different carbon numbers can also be used. The fatty acid residue is represented by RCO— in the above formulae, and the carbon number of the fatty acid residue is represented by the carbon number of R.

Examples of the alkyl group include a hydrocarbon group inducible to a fatty acid residue having a carbon number of 7 to less than 17, e.g., heptyl group, octyl group, 2-ethylhexyl group, nonyl group, isononyl group, decyl group, isodecyl group, undecyl group, isoundecyl group, dodecyl group, isododecyl group, tridecyl group, isotridecyl group, tetradecyl group, pentadecyl group, hexadecyl group, etc., and each branched isomer thereof. Of these, particularly preferable alkyl groups are decyl group, dodecyl group, tetradecyl group and the like.

Examples of the alkenyl group include heptenyl group, octenyl group, nonenyl group, decenyl group, undecenyl group, dodecenyl group, tridecenyl group, tetradecenyl group, pentadecenyl group, hexadecenyl group, etc., and each branched isomer thereof.

Examples of preferable fatty acid glycerides include triglycerides such as caprylic triglyceride, pelargonic triglyceride, caprynic triglyceride, undecanic triglyceride, lauric triglyceride, tridecylic triglyceride, myristic triglyceride, pentadecylic triglyceride, palmitic triglyceride, margaric triglyceride and the like; diglycerides such as caprylic diglyceride, pelargonic diglyceride, caprynic diglyceride, undecanic diglyceride, lauric diglyceride, tridecylic diglyceride, myristic diglyceride, pentadecylic diglyceride, palmitic diglyceride, margaric diglyceride and the like; and monoglycerides such as caprylic monoglyceride, pelargonic monoglyceride, caprynic monoglyceride, undecanic monoglyceride, lauric monoglyceride, tridecylic monoglyceride, myristic monoglyceride, pentadecylic monoglyceride, palmitic monoglyceride, margaric monoglyceride and the like.

Of these, particularly preferable fatty acid glycerides include caprylic triglyceride, 2-ethylhexanic triglyceride, lauric triglyceride, palmitic triglyceride and the like. Diglycerides and monoglycerides using the corresponding fatty acids may also be used.

Further, glycerides consisting of fat and oil such as palm oil, coconut oil and the like are also usable.

The mixing quantity of the carboxylic glyceride may be an effective amount capable of satisfying the transmission torque capacity, the $\mu$-V characteristic and the durability thereof. Preferably, it is 0.01 wt % or more based on the total quantity of the oil composition for automatic transmission, preferably 0.01–5 wt %. It is particularly preferably 0.014 wt %, more preferably 0.01–2.5 wt %. When the mixing quantity is less than 0.01 wt %, the $\mu$-V characteristic is insufficient, and it is difficult to exhibit the shudder preventing performance. When the mixing quantity exceeds 5 wt %, the durable life of shudder preventing performance can be hardly improved.

With respect to the diglyceride, it was seen that an unexpected effect can be obtained in a range of 0.1–0.5 wt %, particularly, as shown in Examples by setting to 2 wt % or less.

Other Additive Components

The oil composition for automatic transmission of this invention contains, as the essential component, at least one of the carboxylic glycerides mixed in the base oil. Various performances are required for automatic transmission oils, and in order to cope with it, various additives or at least one additive selected from the group consisting of viscosity index improver, metallic detergent, ashless dispersant, antioxidant, antiwear agent, extreme pressure agent, pour point depressant, antifoaming agent, corrosion inhibitor and the like can be mixed as occasion demands. The incorporation with viscosity index improver, metallic detergent, ashless dispersant and antiwear agent is particularly preferred. Such a composition can be multifunctionalized, or have functions required as lubricating oil and working fluid in addition to the function as power transmitting medium.

Suitable viscosity index improvers generally include polymethacrylate-based one, olefin copolymer-based one (e.g., polyisobutylene-based and ethylene-propylene copolymer-based one), polyalkyl styrene-based one, hydrogenated styrene-butadiene copolymer-based on e, styrene-maleic anhydride ester copolymer-based on e, and the like. These are generally used at 3–35 wt % based on the total amount of the automatic transmission oil composition.

Metallic detergents include those based on sulfonate, phenate, salicylate and phosphonate of Ca, Mg, Ba, Na or the like. These are generally used at 0.05–5 wt %.

Ashless dispersants include those based on succinimide, succiamide, benzylamine, succinate ester, succinate ester-amide, and those containing boron. Their mixing amounts are 0.05–7 wt %.

Antioxidants generally include amine-based ones, e.g., alkylated is diphenylamine, phenyl-α-naphtylamine, alkylated phenyl-α-naphtylamine, 4,4'-tetramethyldiaminodiphenylamine, etc.; phenolic ones such as 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol), etc.; sulfur-based antioxidants such as dilauryl-3,3'-thiodipropionate, etc.; phosphorous-based ones, e.g., phosphite, etc.; zinc dithiophosphate; and the like. Of these, amine-based and phenol-based ones are preferably used. These are generally used at 0.05–5 wt %.

Antiwear agents generally include zinc dithiophosphate, metallic (e.g., Pb, Sb, Mo, etc.) salts of dithiophosphate, metallic (e.g., Zn, Pb, Sb, Mo, etc.) salts of dithiocarbamate, metallic (e.g., Pb, etc.) salts of fatty acids, boron compound, phosphate ester, phosphite ester, phosphate amine, and the like. These are generally used at 0.1–5 wt %. Of these, zinc dialkylthiophosphate is preferably used. Its mixing amount is preferably 0.01–5 wt %.

Extreme pressure agents generally include ashless-based sulfide compounds, sulfurized oil and fat, phosphate ester, phosphite ester and phosphate ester amine, and the like. These are generally used at 0.05–3 wt %.

Metal deactivators include benzotriazole, derivatives of triazole, benzotriazole and thiadiazole, and the like. These are generally used at 0.01–3 wt %.

Pour point depressants generally include ethylene-vinyl acetate copolymers, condensate of chlorinated paraffin and naphthalene, condensate of chlorinated paraffin and phenol, polymethacrylates, polyalkyl styrene and the like. Of these, a polymethacrylate is preferably used. They are generally used at 0.01–10 wt %.

Antifoaming agents include dimethylpolysiloxane and the like. It is generally added in an extremely small quantity, e.g., about 0.0001–1 wt %.

The oil composition for automatic transmission of this invention is extremely useful for lock-up clutch and slip control and exhibits an excellent effect. It is, of course, usable also for automatic transmissions equipped with no slip control mechanism.

EXAMPLE

This invention is described further more particularly by the following non-limiting Examples and Comparative Examples.

The transmission torque capacity and the $\mu$(coefficient of friction)-V(slip velocity) characteristic were evaluated by use of the following measurement methods. As other additives, those described below were used.

Transmission Torque Capacity

The transmission torque capacity of the oil composition for automatic transmission was evaluated as the transmittable torque capacity in a wet clutch part by using a tester SAE No. 2 in accordance with the test method for automatic transmission oil friction characteristic by JASO 348-98 and measuring the coefficient of friction ($\mu_\tau$) in 1000 cycles of a sample oil under the following test conditions. It was regarded that the one having a higher coefficient of friction ($\mu_\tau$) has a larger torque capacity, and samples oils having a coefficient of friction ($\mu_\tau$) equal to or larger than the coefficient of friction 0.13 of Castle brand ATF-T-III selected as a commercially available high performance automatic transmission oil for slip control was judged as "passable" (i.e. passing).

Test Conditions

| | |
|---|---|
| Friction Material | Wet paper material |
| Test Temperature | 100° C. |
| Oil Quantity | 800 ml |
| Surface Pressure | 8 kgf/cm$^2$ |

$\mu$-V Characteristic

The test method for $\mu$-V characteristic is based on the test method for automatic transmission shudder preventing performance by JASO M349-98. It was defined that the shudder preventing performance is exhibited when $d\mu/dV$ is positive and lost when $d\mu/dV$ is negative. The time of $d\mu/dV<0$ was measured for each sample oil, and it was defined that a sample oil whose durability of $d\mu/dV$ is equal to or more than that of the commercially available automatic transmission oil for slip control "Castle ATF-T-III" is "passable", and a sample oil whose durability is less than that of the commercially available product is "impassable" (i.e. not passing).

Other Additives (Commercially Available Products)

| | | Mixing Amount (wt %) |
|---|---|---|
| Viscosity Index Improver | Polymethacrylate (RohMax) | 8.5 |
| Metallic Detergent | Calcium phenate (Infinium Japan) | 1.0 |
| Ashless Dispersant | Succinimide (Exxon Chemical) | 6.0 |
| Antiwear Agent | Phosphate ester (Sakai Chemical) | 0.1 |

Example 1

A solvent-refined paraffinic mineral oil (kinematic viscosity at 100° C.: 4 mm$^2$/s) was used as a base oil, and 2 wt %, based on the whole composition, of lauric triglyceride as friction modifier and the above respective prescribed quantities or 15.6 wt % in total of the viscosity index improver, metallic detergent, ashless dispersant and antiwear agent were mixed to the mineral oil to prepare an oil composition for automatic transmission.

The transmission torque capacity and $\mu$-V characteristic were measured for this oil composition for automatic transmission according to the above methods. As a result, the SAE No. 2 torque capacity ($\mu_\tau$) was 0.14. For the $\mu$-V characteristic, $d\mu/dV$ could keep a positive gradient even if a continuous slip lasted for a long time, and the time of its changing to negative (hereinafter referred to as "the time of $d\mu/dV<0$" for short) was 191 hours. It was proved from the above that both the transmission torque capacity and the shudder preventability durability were extremely excellent. The evaluation result is shown in Table 1 and FIG. 1.

Example 2

A solvent-refined paraffinic mineral oil (kinematic viscosity at 100° C.: 4 mm$^2$/s) was used as a base oil, and 2 wt %, based on the whole composition, of caprylic triglyceride as friction modifier and the above respective prescribed quantities or 15.6 wt % in total of the viscosity index improver, metallic detergent, ashless dispersant and antiwear agent were mixed to the mineral oil to prepare an oil composition for automatic transmission.

The transmission torque capacity and $\mu$-V characteristic were measured for this oil composition for automatic transmission according to the above methods. As a result, the SAE No. 2 torque capacity ($\mu_\tau$) was 0.14. For the $\mu$-V characteristic, the time of $d\mu/dV<0$ reached 69 hours, which showed that the $\mu$-V characteristic was excellent. The evaluation result is shown in Table 1.

Example 3

A solvent-refined paraffinic mineral oil (kinematic viscosity at 100° C.: 4 $mm^2/s$) was used as a base oil, and 0.2 wt %, based on the whole composition, of lauric diglyceride as friction modifier and the above respective prescribed quantities or 15.6 wt % in total of the viscosity index improver, metallic detergent, ashless dispersant and antiwear agent were mixed to the mineral oil to prepare an oil composition for automatic transmission.

The transmission torque capacity and UV characteristic were measured for this oil composition for automatic transmission according to the above methods. As a result, the SAE No. 2 torque capacity ($\mu_\tau$) was 0.14. For the $\mu$-V characteristic, the time of $d\mu/dV<0$ reached 75 hours, which showed that the $\mu$-V characteristic was excellent. The evaluation result is shown in Table 1.

Example 4

A solvent-refined paraffinic mineral oil (kinematic viscosity at 100° C.: 4 $mm^2/s$) was used as a base oil, and 4 wt %, based on the whole composition, of lauric triglyceride as friction modifier and the above respective prescribed quantities or 15.6 wt % in total of the viscosity index improver, metallic detergent, ashless dispersant and antiwear agent were mixed to the mineral oil to prepare an oil composition for automatic transmission.

The transmission torque capacity and UV characteristic were measured for this oil composition for automatic transmission according to the above methods. As a result, the SAE No. 2 torque capacity ($\mu_\tau$) was 0.15. For the UV characteristic, the time of $d\mu/dV<0$ was as long as 170 hours, which proved that the UV characteristic was extremely excellent. The evaluation result is shown in Table 1.

Comparative Example 1

Castle ATF-T-III was selected as a commercially available high performance oil used for automatic transmissions with slip control mechanism and subjected to the above performance evaluation. As a result, the SAE No. 2 torque capacity ($\mu_\tau$) was 0.13, while $\mu$-V characteristic was changed to negative at a continuous slip time of about 50 hours (the time of $d\mu/dV<0$: about 50 hours). The evaluation result is shown in Table 2 and FIG. 1.

Comparative Example 2

A solvent-refined paraffinic mineral oil (kinematic viscosity at 100° C.: 4 $mm^2/S$) was used as a base oil, and 2 wt %, based on the whole composition, of methyl laurate as friction modifier and the above respective prescribed quantities or 15.6 wt % in total of the viscosity index improver, metallic detergent, ashless dispersant and antiwear agent were mixed to the mineral oil to prepare an oil composition for automatic transmission.

The transmission torque capacity and $\mu$-V characteristic were measured for this oil composition for automatic transmission according to the above methods. As a result, the SAE No. 2 torque capacity ($\mu_\tau$) was 0.15, while the time of $d\mu/dV<0$, for the $\mu$-V characteristic, was 22 hours, which showed that the $\mu$-V characteristic was extremely inferior. The evaluation result is shown in Table 2.

Comparative Example 3

A solvent-refined paraffinic mineral oil (kinematic viscosity at 100° C.: 4 $mm^2/s$) was used as a base oil, and 0.2 wt %, based on the whole composition, of lauric monoglyceride as friction modifier and the above respective prescribed quantities or 15.6 wt % in total of the viscosity index improver, metallic detergent, ashless dispersant and antiwear agent were mixed to the mineral oil to prepare an oil composition for automatic transmission.

The transmission torque capacity and $\mu$-V characteristic were measured for this oil composition for automatic transmission according to the above methods. As a result, the SAE No. 2 torque capacity ($\mu_\tau$) was 0.13. For the $\mu$-V characteristic, the time of $d\mu/dV<0$ was 59 hours. The evaluation result is shown in Table 2 and FIG. 1.

Comparative Example 4

An oil composition for automatic transmission having the same component composition as Comparative Example 3 except using 2 wt % of lauric monoglyceride was prepared.

The torque capacity and $\mu$-V characteristic were measured for this oil composition for automatic transmission according to the above methods. As a result, the SAE No. 2 torque capacity ($\mu_\tau$) was 0.09. For the $\mu$-V characteristic, the measurement for the time of $d\mu/dV<0$ was stopped when 250 hours passed. The evaluation result is shown in Table 2.

Comparative Example 5

A solvent-refined paraffinic mineral oil (kinematic viscosity at 100° C.: 4 $mm^2/s$) was used as a base oil, and 2 wt/o, based on the whole composition, of olefinic triglyceride as friction modifier and the above respective prescribed quantities or 15.6 wt % in total of the viscosity index improver, metallic detergent, ashless dispersant and antiwear agent were mixed to the mineral oil to prepare an oil composition for automatic transmission.

The transmission torque capacity and $\mu$-V characteristic were measured for this oil composition for automatic transmission according to the above methods. As a result, the SAE No. 2 torque capacity ($\mu_\tau$) was 0.14. For the $\mu$-V characteristic, the time of $d\mu/dV<0$ was as short as 19 hours, which showed that the $\mu$-V characteristic was inferior. The evaluation result is shown in Table 2.

TABLE 1

| Example No. | | 1 | 2 | 3 | 4 |
|---|---|---|---|---|---|
| Composition | | | | | |
| Base oil*1 | | 82.4 | 82.4 | 84.2 | 80.4 |
| Carboxylic glyceride | Caprylic triglyceride (wt %) | | 2 | | |
| | Lauric triglyceride | 2 | | | 4 |
| | Lauric diglyceride | | | 0.2 | |
| | Lauric monoglyceride | | | | |
| | Oleinic triglyceride | | | | |
| | Methyl Laurate | | | | |

TABLE 1-continued

| Example No. | 1 | 2 | 3 | 4 |
|---|---|---|---|---|
| Other Additives*2 | 15.6 | 15.6 | 15.6 | 15.6 |
| SAE No. 2 Torque capacity $\mu_\tau$*3 | 0.14 | 0.14 | 0.14 | 0.15 |
| Test method is based on JASO M348-98 Passability*4 | Passable | Passable | Passable | Passable |
| $\mu$-V Characteristic | FIG. 1 | Passable | Passable | Passable |
| Test method is based on JASO M349-98 Passability*5 | Passable | | | |
| Time of d$\mu$/dV < 0 (hr) | 191 | 69 | 75 | 170 |

*1Solvent-refined paraffinic mineral oil (kinematic viscosity at 100° C.: 4 $mm^2/s$).
*2As other additives, viscosity index improver, metallic detergent, dispersant, and antiwear agent were mixed.
*3Coefficient of friction @ 1000 cycles.
*4Those showing $\mu\tau$ equal to or more than Comparative Example 1 were judged as passable (i.e. passing).
*5Those showing durability equal to or more than Comparative Example 1 were judged as passable (i.e. passing).

TABLE 2

| Comparative Example No. | | 1 | 2 | 3 | 4 | 5 |
|---|---|---|---|---|---|---|
| Composition | | | | | | |
| Base oil*1 | | Castle | 82.4 | 84.2 | 82.4 | 82.4 |
| Carboxylic glyceride | Caprylic triglyceride (wt %) | ATF | | | | |
| | Lauric triglyceride | T III | | | | |
| | Lauric diglyceride | | | | | |
| | Lauric monoglyceride | | | 0.2 | 2 | |
| | Oleinic triglyceride | | | | | 2 |
| | Methyl Laurate | | 2 | | | |
| Other Additives*2 | | | 15.6 | 15.6 | 15.6 | 15.6 |
| SAE No. 2 Torque capacity $\mu_\tau$*3 | | 0.13 | 0.15 | 0.13 | 0.09 | 0.14 |
| Test method is based on JASO M348-98 Passability*4 | | | Passable | Passable | Impassable | Passable |
| $\mu$-V Characteristic | | FIG. 1 | Impassable | FIG. 1 | Passable | Impassable |
| Test method is based on JASO M349-98 Passability*5 | | | | Impassable | | |
| Time of d$\mu$/dV < 0 (hr) | | 57 | 22 | 59 | 250 | 29 |

*1Solvent-refined paraffinic mineral oil (kinematic viscosity at 100:4 $mm^2/s$).
*2As other additives, viscosity index improver, metallic detergent, dispersant, and antiwear agent were mixed.
*3Coefficient of friction @ 1000 cycles.
*4Those showing $\mu_\tau$ equal to or more than Comparative Example 1 were judged as passable (i.e. passing).
*5Those showing durability equal to or more than Comparative Example 1 were judged as passable (i.e. passing).

EFFECT OF THE INVENTION

As described so far, a carboxylic glyceride having a specified carboxylic acid residue is used as the component, whereby an oil composition for automatic transmission having high wet friction material torque capacity and shudder preventing performance with $\mu$-V characteristic of positive gradient, and enhanced also in durability of shudder preventing performance can be provided.

What is claimed is:

1. An oil composition for automatic transmission equipped with a lock-up clutch and slip control mechanism, said oil composition comprising a carboxylic glyceride mixed with a base oil, and at least one automatic transmission fluid performance additive, the carboxylic glyceride consisting of a carboxylic triglyceride or a mixture of a carboxylic triglyceride and a carboxylic diglyceride, each carboxylic acid residue thereof having a carbon number of 7 to less than 17, the mixing amount thereof being 0.01 wt % to 5 wt % based on the whole composition, the automatic transmission fluid containing said carboxylic glyceride being characterized by a coefficient of friction equal to or greater than 0.13 $\mu$ and a time of d$\mu$/dv changing to negative (time of d$\mu$/dv<0) of 57 hours or more.

2. The oil composition for automatic transmission of claim 1 wherein the carboxylic glyceride is a fatty acid triglyceride having a fatty acid residue having a carbon number of 7 to less than 17.

3. The oil composition for automatic transmission of claim 1 wherein the carboxylic glyceride is a fatty acid triglyceride having a fatty acid residue having a carbon number of 10–14.

4. The oil composition for automatic transmission of claim 1 wherein the carboxylic glyceride is a fatty acid diglyceride having a fatty acid residue having a carbon number of 7 to less than 17, and the mixing amount being 2 wt % or less.

5. An oil composition for automatic transmission equipped with a lock-up clutch and slip control mechanism, said oil composition comprising a carboxylic glyceride mixed with a base oil, and at least one automatic transmission fluid performance addition, the carboxylic glyceride consisting of a mixture of fatty acid triglyceride, fatty acid diglyceride and fatty acid monoglyceride wherein 20 wt % or more of the total of all the fatty acid glyceride is fatty acid triglyceride, each carboxylic acid residue of the carboxylic glycerides having a carbon number of 7 to less than 17, the mixing amount thereof being 0.01 wt % to 5 wt % based on the whole composition, the automatic transmission fluid containing said carboxylic glyceride being characterized by a coefficient of friction equal to or greater than 0.13 $\mu$ and a time of $d\mu/dv$ changing to negative (time of $d\mu/dv<0$) of 57 hours or more.

6. The oil composition for automatic transmission of claim 5 wherein the fatty acid triglyceride constitutes 40 wt % or more of the total of all the fatty acid glycerides.

7. The oil composition for automatic transmission of claim 6 wherein the carboxylic acid residue of the carboxylic glyceride has a carbon number of 10 to 14.

8. The oil composition for automatic transmission of claim 5 wherein the carboxylic acid residue of the carboxylic glyceride has a carbon number of 10 to 14.

9. The oil composition for automatic transmission of claim 1, 2, 3, 5, 6, 8 or 7 wherein the mixing amount of the carboxylic glyceride is 0.01 to 4 wt % based on the whole composition.

10. The oil composition for automatic transmission of claim 1, 2, 3, 5, 6, 8 or, 7 wherein the mixing amount of the carboxylic glyceride is 0.01 to 25 wt % based on the whole composition.

* * * * *